US005548388A

United States Patent [19]

Schieck

[11] Patent Number: 5,548,388

[45] Date of Patent: Aug. 20, 1996

[54] VACUUM TRANSPORT APPARATUS

[75] Inventor: Richard A. Schieck, Rochester, N.Y.

[73] Assignee: Xerox Corporation, Stamford, Conn.

[21] Appl. No.: 533,052

[22] Filed: Sep. 25, 1995

[51] Int. Cl.[6] ..... G03G 15/00; B65H 5/02

[52] U.S. Cl. ..... 355/309; 355/312; 271/197

[58] Field of Search ..... 355/309, 312; 271/196, 197, 198; 198/689.1

[56] References Cited

U.S. PATENT DOCUMENTS 4,494,166 1/1985 Billings, et al. ..... 361/214

5,031,002 7/1991 Yaguchi ..... 355/312

5,133,543 7/1992 Eitel et al. ..... 271/197 X

*Primary Examiner*—Joan H. Pendegrass

*Assistant Examiner*—Quana Grainger

*Attorney, Agent, or Firm*—William A. Henry, II

[57] ABSTRACT

A limited drive force prefuser vacuum transport apparatus includes at least two sets of belts entrained around a vacuum plenum to provide a limited drive force on sheets being driven by the vacuum transport apparatus. One set of the belts is deliberately driven at a lower speed than the other of the at least two sets of belts in order to maintain the ability of limited slip of sheets on the vacuum belt transport, thus accommodating speed variations among components of a copier/printer including a photoreceptor, paper transport and fuser.

5 Claims, 2 Drawing Sheets

VACUUM TRANSPORT APPARATUS

BACKGROUND OF THE INVENTION

This invention relates to copy sheet transport systems, and more particularly, to an improved prefuser vacuum transport for copy sheet transported in a copier/printer.

In copier/printer machines, it is common to transport sheets from the photoreceptor to the fuser by means of a multi-belt vacuum transport. Substantial vacuum pressure is usually desirable to provide adequate control over each sheet. This is especially true in machines where the unfused toner image is on the underside of the sheet and the sheet must be suspended from the underside of the vacuum transport. Other factors such as paper curl, cockle and high stiffness also increase pressure requirements.

While under joint influence of the photoreceptor tack force and the prefuser transport vacuum force, the sheet may transmit forces in the forward or backward direction from the prefuser transport to the photoreceptor due to speed mismatches or motion perturbations between the two. In machines, such as color printers, where motion quality of the photoreceptor is critical, these forces can perturb photoreceptor motion during exposure of a subsequent image affecting image quality and color registration. Thus, it would be an advantage to limit the drive force of the transport such that these disturbances are minimized.

PRIOR ART

A typical copy sheet vacuum transport assembly that is used to transport copy sheets between a photoreceptor and a fuser of an electrophotographic apparatus is disclosed in U.S. Pat. No. 4,494,166 and includes a plurality of belts entrained around a vacuum plenum which pull each sheet being transported against the plurality of belts and propels each sheet until the hold of the vacuum from the plenum is no longer effective.

SUMMARY OF THE INVENTION

Accordingly, a limited drive force prefuser vacuum transport apparatus is disclosed that includes at least two sets of belts entrained around a vacuum plenum to provide a limited drive force on sheets being driven by the vacuum transport apparatus. One set of the belts is deliberately driven at a lower speed than the other of the at least two sets of belts in order to maintain the ability of limited slip of sheets on the vacuum belt transport, thus accommodating speed variations among components of a copier/printer including a photoreceptor, paper transport and fuser.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

The invention will now be described by reference to a preferred embodiment of the prefuser vacuum transport system of the present invention preferably for use in a conventional copier/printer. However, it should be understood that the sheet vacuum transport method and apparatus of the present invention could be used with any machine environment in which transport of sheets is desired.

Figure 1:
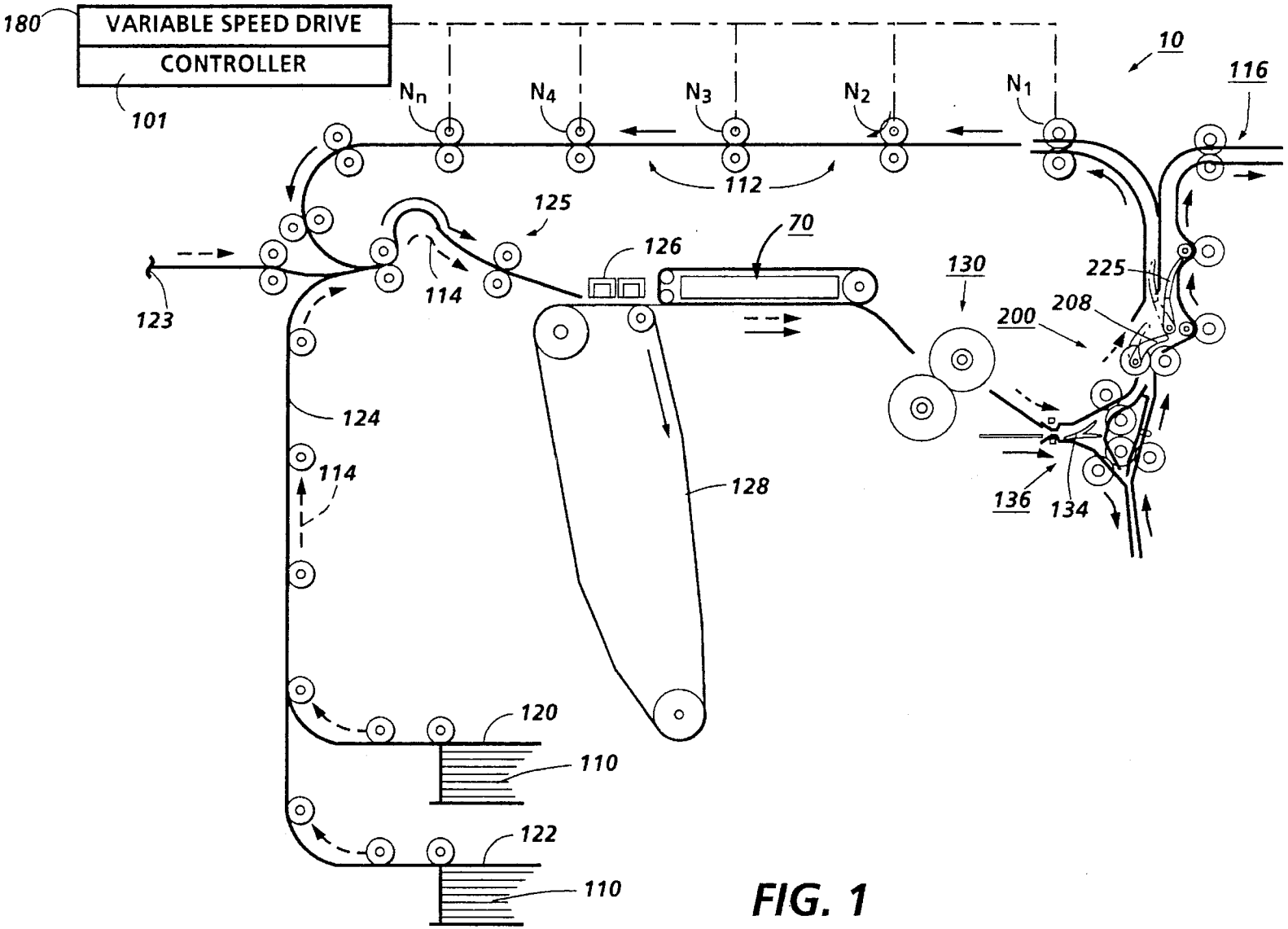
FIG. 1 is an elevational view of an illustrative printing machine incorporating the limited drive force prefuser vacuum transport apparatus of the present invention.

For a general understanding of the features of the present invention, reference is made to the drawings. In the drawings like reference numerals have been used throughout to designate identical elements. FIG. 1 schematically depicts the various components of an illustrative electrophotographic printing machine incorporating the prefuser vacuum transport apparatus of the present invention therein.

Describing first in further detail the exemplary printer embodiment with reference to FIG. 1, there is shown a duplex laser printer 10 by way of example of automatic electrostatographic reproducing machines of a type like that of the existing commercial Xerox Corporation "DocuTech" printer shown and described in U.S. Pat. No. 5,095,342 suitable to utilize the vacuum transport system of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed prefuser vacuum transport system.

Turning now more specifically to this FIG. 1 system 10, the photoreceptor is 128, the clean sheets 110 are in paper trays 120 and 122 (with an optional high capacity input path 123), the vertical sheet input transport is 124, transfer is at 126, fusing at 131:), inverting at 136 selected by gate 134, decurling at 200 with the use of gates 208 and 225, etc. There is an overhead duplex loop path 112 with plural variable speed feed rollers $N_1$–$N_n$ providing the majority of the duplex path 112 length and providing the duplex path sheet feeding nips; all driven by a variable speed drive 180 controlled by the controller 101. This is a top transfer (face down) system. Gate 208 selects between output 116 and dedicated duplex return loop 112 here.

In this FIG. 1 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 1, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134 directly to output 116. However, if the sheet is being duplexed and is then only printed with a side one image, the gate 134 will be positioned by a sensor (not shown) and controller 101 to deflect that sheet into the inverter 136 of the duplex loop path 112, where that sheet will be inverted and then fed to sheet transports 124 and 125 for recirculation back through transfer station 126 and fuser 130 for receiving and permanently fixing the side two image to the backside of that duplex sheet, before it exits via exit path 116. All of the sheets pass through decurler 200.

Figure 2:
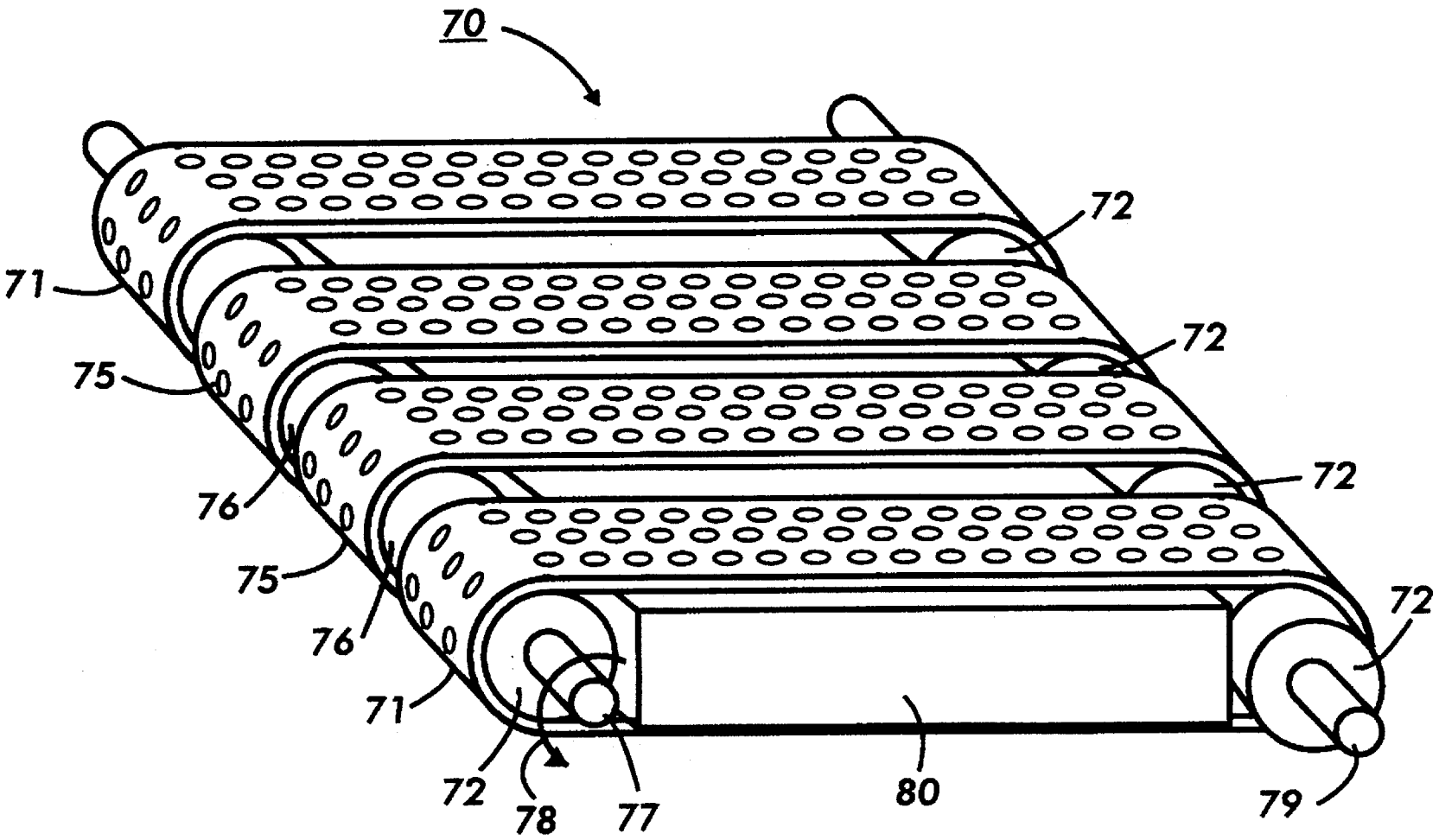
FIG. 2 is an isometric view of the limited drive force prefuser vacuum transport apparatus shown in FIG. 1

In accordance with the present invention, as more specifically shown in FIG. 2, a limited drive force prefuser transport 70 is disclosed as comprising at least two sets of perforated belts 71 and 75 that are entrained around drive rolls 72 and 76, respectively, and around idler shaft 79 mounted for rotation on shaft 79'. Drive rolls 72 and 76 are mounted for rotation by shaft 77 in the direction of arrow 78 in order to drive sheets in the direction of fuser 130. Vacuum plenum 80 is situated between perforated belts 71 and 75 to apply vacuum pressure to the non-imaged sided of copy sheets that have received images at transfer station 126. The vacuum plenum attaches individual copy sheets to the outer surface of belts 71 and 75 and they are transported to fuser 130 where the unfused image on the sheets is fused to the copy sheets.

To answer the need to limit the drive force of vacuum transport 70 in order to minimize disturbances of non-fused images as they are transported to the fuser, the transport assembly 70 limits the drive force against copy sheets while maintaining constant vacuum pressure. In practice, prefuser vacuum transport 70 provides limited slip to copy sheets by driving some of the belts slower than others. This is accomplished by providing different drive radii along the length of the drive rolls 71 and 75, such that drive belts 75 are driven slower than drive belts 71. If the sheet speed (determined by the photoreceptor) is kept between the speed of the "fast" and "slow" belts, the maximum forward or backward disturbance which can be transmitted to the photoreceptor can be calculated as:

$$F_d = P_v(A_f - A_s)\ U_{bp}$$

where:

$F_d$=maximum disturbance force $P_v$=transport vacuum pressure $A_f$=vacuum area of the "fast" belts $A_s$=vacuum area of he "slow" belts $U_{bp}$=coefficient of friction from belts to paper Meanwhile, the sheet is prevented from falling below the "slow" speed by a much larger force which equals $P_v(A_f+A_s)$ $U_{bp}$. This reduces the possibility of accidental stall of the sheet once it is no longer driven by the photoreceptor.

The introduction of skew from belts of different speeds driving a single sheet must be considered in the design of limited drive force prefuser transport 70. This tendency to skew can be overcome by: a) balancing the positions of "fast" and "slow" belts across the sheet; b) maintaining a totally symmetric design; and c) reducing the vacuum of the slower belts through smaller perforation size for modification of the vacuum plenum. The limited drive force prefuser transport 70 of the present invention is advantaged over using stationary belts or skids on the transport in a number of ways. First, the sheet is prevented from dropping below the slower of the two speeds by the combined drive force from all the belts as previously described. However, with stationary skids, the net drive force is reduced at all speeds. Second, limited drive force prefuser transport 70 is less costly than stationary belts or skids.

In addition, an advantage of using this transport is that it limits forward and rearward torque spikes transmitted by a sheet to the photoreceptor. These spikes are induced by perturbations in the transport's motion relative to the photoreceptor's motion. These spikes can cause photoreceptor motion quality disturbances which are problematic if they occur during exposure of a subsequent image by scanning exposure device, such as a raster output scanner (ROS), light emitting diode, etc. In short, a forward tug by a sheet may cause the photoreceptor to jump forward. If exposure is occurring elsewhere on the photoreceptor belt at the same time, two successive ROS scan lines will be spread apart, offsetting the associated latent image from where it should be. This is especially a problem in "image-on-image" exposure color machines. The prefuser transport of the present invention is especially useful in this environment because the prefuser suspends each sheet on its underside when transporting it to the fuser. This requires higher vacuum pressure which in turn "glues" each sheet more firmly to the transport thereby increasing the transmission of motion perturbations back to the photoreceptor if not for the limited slip feature of the vacuum transport of the present invention.

It should now be apparent that a multi-belt, limited drive force, prefuser vacuum transport has been disclosed that features driving some of the multiple belts at lower speeds than others. This feature allows limited slip of sheets on the vacuum transport, the hereby accommodating speed variations between the photoreceptor and paper transport.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. A copier/printer including a photoreceptor having page images thereon, copy sheets for receiving the page images from the photoreceptor, a transfer apparatus for transferring the page images from the photoreceptor to the copy sheets and a fuser for fusing the page images on the copy sheets, comprising:

a limited slip prefuser vacuum transport apparatus positioned between the photoreceptor and fuser adapted to receive copy sheets from the photoreceptor and transport them to the laser, said limited slip prefuser vacuum transport apparatus including a vacuum plenum; a plurality of drive rolls and at least one idler roll; a plurality of perforated belts including at least four belts entrained around said drive rolls, idler roll and vacuum plenum; and means for driving at least two of said plurality of perforated belts at a slower speed than the remainder of said plurality of perforated belts to accommodate speed variations between the photoreceptor, fuser and vacuum transport and thereby maintain image copy quality.

2. The copier/printer of claim 1, wherein said means for driving said at least two of said plurality of perforated belts at a slower speed than the remainder of said plurality of perforated belts is a pair drive rolls having less of a radii than the remainder of said plurality of drive rolls.

3. A vacuum transport apparatus for accommodating speed variations between a photoreceptor and fuser of a copier/printer, comprising:

a vacuum plenum;

a plurality of drive rolls positioned adjacent one end of said vacuum plenum;

at least one idler roll positioned at an end of said vacuum plenum opposite said one end; and a plurality of perforated belts surrounding said plurality of drive rolls, vacuum plenum and at least one idler roll, and wherein said plurality of common shaft mounted drive rolls are adapted to provide limited slip of sheets attached thereto by the negative pressure of said vacuum plenum by having a number of said plurality of perforated belts driving at a slower speed than others, and wherein at least two of said plurality of drive rolls have less of a radii than the remainder of said plurality of drive rolls.

4. The vacuum transport of claim 3, wherein said idler roll is an elongated shaft.

5. A limited drive force prefuser vacuum transport apparatus, comprising a vacuum plenum; a plurality of drive rolls mounted on a common shaft with at least two of said plurality of drive rolls having less of a radii than the remainder of said plurality of drive rolls and at least one idler roll; and at least two sets of perforated belts entrained around said plurality of drive rolls, said idler roll and said vacuum plenum to provide a limited drive force on sheets being driven by drive rolls, and wherein one set of said plurality of belts is deliberately driven by said at least two of said plurality of drive rolls at a lower speed than the other of said at least two sets of drive belts that are driven by the remainder of said plurality of drive rolls in order to maintain the ability of limited slip of sheets on the vacuum belt transport, thus accommodating speed variations among components of a machine.

* * * * *